US005659911A

United States Patent [19]

Kirkbride et al.

[11] Patent Number: 5,659,911

[45] Date of Patent: Aug. 26, 1997

[54] SYNTHETIC POLYESTER FIBER PILLOWS WITH IMPROVED TICKING

[75] Inventors: James Frederick Kirkbride, Wilmington, Del.; Adrian Charles Snyder, Greenville, N.C.

[73] Assignee: E. I. Du Pont de Nemours and Company, Wilmington, Del.

[21] Appl. No.: 715,973

[22] Filed: Sep. 18, 1996

Related U.S. Application Data

[63] Continuation-in-part of Ser. No. 438,301, May 10, 1995, abandoned, which is a continuation-in-part of Ser. No. 129,277, Sep. 30, 1993, abandoned, which is a continuation-in-part of Ser. No. 10,215, Jan. 28, 1993, Pat. No. 5,344,707.

[51] Int. Cl.[6] ..... A47C 20/02

[52] U.S. Cl. ..... 5/636; 5/952; 5/490; 428/401; 428/76

[58] Field of Search ..... 428/298, 401, 428/76; 5/636, 652, 490, 952

[56] References Cited

U.S. PATENT DOCUMENTS 5,344,707 9/1994 Snyder ..... 428/359

*Primary Examiner*—Kathleen L. Choi

[57] ABSTRACT

Synthetic polyester fiber pillows have improved ticking fabrics of continuous filament polyester yarns, particularly of microdenier, and that may be sanded.

5 Claims, 1 Drawing Sheet

SYNTHETIC POLYESTER FIBER PILLOWS WITH IMPROVED TICKING

CROSS REFERENCE TO RELATED APPLICATION

This application is a continuation-in-part of our application No. 08/438,301 (DP-6215-A), filed May 10, 1995, which is being abandoned and which itself was filed as a continuation-in-part of our application No. 08/129,277 (DP-6215), filed Sep. 30, 1993, and now abandoned and which was itself filed as a continuation-in-part of application No. 08/010,215 (DP-4615-B), filed Jan. 28, 1993 by Snyder, now U.S. Pat. No. 5,344,707.

FIELD OF THE INVENTION

This invention relates to synthetic polyester fiber pillows filled with synthetic polyester fiber fill, as filling material, and with improved tickings, and is more particularly concerned with such tickings being woven fabrics consisting essentially entirely of polyester continuous filament multifilamentary yarns, and especially of such yarns containing subdenier filaments.

BACKGROUND OF PILLOW DEVELOPMENT

For many years, down, and down mixed with feathers, were the predominant products for use as filling materials for pillows and sleeping bags. Although durability and resilience are very good (so long as they are not wetted), down and down/feather blends have significant deficiencies. They matt when washed, so dry cleaning is recommended in contrast to home-laundering. The feather quills poke through the ticking and the down passes through the ticking, resulting in loss of pillow height. Many people are allergic to feathers and down. Furthermore, down is very expensive. To overcome these limitations, crimped synthetic staple fiber, particularly polyester fiberfill, has been used as a filling material for pillows instead of down. Synthetic "staple fiber" has been cut so as to provide short discontinuous pieces of a desired length or "staple".

Initial attempts to use polyester fiberfill cut staple fiber as filling material were disappointing because staple fiber filling material tended to clump after prolonged use. A steady stream of modifications leading to improved performance of filling materials have appeared over the years. One of the first developments was the use of slickeners to permit the fibers to slip past each other more readily, which reduced the tendency to clump, as disclosed, for example, in U.S. Pat. No. 3,271,189. The use of hollow fibers as polyester fiber fill staple in place of solid fibers was described by Tolliver in U.S. Pat. No. 3,772,137. An important recent development was the introduction of very small fiberballs, sometimes referred to as "puffs" or as rounded clusters of staple fibers, as filling material. The preparation and properties of fiberballs are described by Marcus in U.S. Pat. Nos. 4,618,531 and 4,794,038. Snyder, et al, U.S. Pat. No. 5,218,740 and Halm, et al, U.S. Pat. No. 5,112,684, for example, describe different techniques for preparing fiberballs or rounded fiber clusters.

From a review of the patent literature it is apparent that efforts to improve the performance of pillows have been focused on the filling material. The nature or identity of the ticking material is rarely mentioned, although it is believed that the pillow trade has recognized that the appearance and tactile qualities of the ticking can be important elements of customer appeal.

For clarification, a pillow is normally sold as illustrated in FIGS. 1 and 2 of the accompanying drawings, wherein FIG. 1 is a perspective view, and FIG. 2 is a view in section in direction 2—2 shown in FIG. 1. The pillow, shown generally as 11, comprises an outer fabric covering 12, which is referred to in the trade as a "ticking", that surrounds the filling material, shown schematically as 13, which may be loose staple fiber, but was generally in the form of a rolled batt, as disclosed, e.g., by LeVan in U.S. Pat. No. 3,510,888, or more recently as very small fiberballs or clusters, as mentioned above, or can be in the form of deregistered continuous filamentary tow, as disclosed, e.g., by Watson in U.S. Pat. Nos. 3,328,850 and 3,952,134. The ticking generally has a zipper (not shown) or other means whereby it may be opened and closed for introducing, removing and retaining the filling material.

In use, such pillows are generally provided with a removable pillow slip, for convenience for laundering separately, without the need for washing the pillow, and for aesthetics, e.g., to match other bed linen which may be varied from time to time. Such a pillow slip is not to be confused with the ticking that is referred to herein. Traditionally, pillow ticking fabrics have often been striped and made of yarns spun (i.e., formed by twisting together) from durable hard-wearing cotton (which is a natural staple fiber) or other staple fiber. When the term "spun yarn" has been used, this term has been used to indicate yarns that have been formed by spinning cotton and/or synthetic cut fibers into a continuous strand; in other words, discontinuous fibers have been spun (as, for example, on an old-fashioned spinning wheel), i.e., twisted together into a continuous strand (or yarn) of such discontinuous fibers. The term "spun yarn" has not been used in the trade to refer to yarns of continuous filaments, such as silk or continuous synthetic filaments. So far as is known, wholly continuous filament synthetic polymer fabrics have not been used to make pillow tickings, although they have been used to enclose fiberfill in other filled articles, such as apparel, sleeping bags and comforters.

It has now been found, according to the invention, that ticking fabrics wholly of synthetic polyester continuous filaments, especially containing subdenier filaments, can have an unexpected influence on the physical behavior of pillows.

SUMMARY OF THE INVENTION

The essential feature of the invention is the ticking fabrics, that are provided according to the invention in combination with polyester fiberfill filling material that is already known to the art.

According to the invention, pillows are provided comprising synthetic polyester fiberfill, as filling material, enclosed within a ticking of fabric that is woven essentially entirely of yarns of synthetic polyester continuous filaments, wherein at least 10% by weight of such continuous polyester filaments, preferably 10 to 50% by weight, are of low denier per filament (dpf) less than about 1.5, generally about 0.4 to about 1.5. Preferred low denier polyester continuous filaments are of denier per filament about 0.4 to about 0.9. If desired, the low dpf continuous filaments may be used with polyester continuous filaments of larger denier per filament such as about 1.0 to about 6.0, preferably about 1.0 to about 3.0.

We were very surprised to find significant improvements in pillows according to our invention when compared with pillows using existing prior art commercial tickings. This will be discussed in greater detail hereinafter in relation to comparative tests using the same synthetic polyester fiberfill as filling material, but comparing pillows with tickings of fabric woven wholly of yarns of synthetic polyester continuous filaments according to the invention vs. pillows having the same synthetic polyester fiberfill as filling material but with commercial prior art ticking fabrics. Such commercial prior art ticking fabric, of course, contained cotton and/or synthetic staple fiber in contrast to the tickings used for pillows according to the invention. Briefly, however, we were surprised that the "Softness" of pillows according to the invention increased significantly less (lower % Δ Softness, as shown in Table 1, hereinafter) after three cycles of compression, washing and drying in contrast to greater increases (higher % Δ Softness) experienced by the pillows using commercial prior art ticking fabrics (containing cotton and/or synthetic staple fiber). It was also surprising that the change (Δ) in the "Firmness" of pillows according to the invention was generally much less than for the pillows using the commercial prior art ticking fabrics. This surprising advantage of the pillows of the invention can be expressed briefly as better Softness durability. These various terms are explained and defined hereinafter in relation to Table 1.

Sanded fabrics are especially preferred for use as ticking fabrics in pillows of the invention, as they have provided excellent tactile aesthetics. It will be understood that the purpose of sanding is to break some of the continuous filaments in the yarns composing the woven fabric and so generate broken filament ends in one or both surfaces of the fabric that has been woven from continuous filament yarns. Such sanded fabrics are, however, entirely different from fabrics of yarns formed from discontinuous staple fibers in that only some of the continuous filaments in the sanded fabrics have been broken and in that these broken ends are only in a surface of the sanded fabrics. Textured filaments are also preferred as they provide especially pleasing tactile aesthetics in the tickings used in pillows according to the invention.

The preferred fiberfill is in the form of fiberballs, especially those containing subdenier fibers as disclosed in parent Application No. 08/010,215, now U.S. Pat. No. 5,344,707, referred to above.

DETAILED DESCRIPTION OF THE INVENTION

Figure 1:
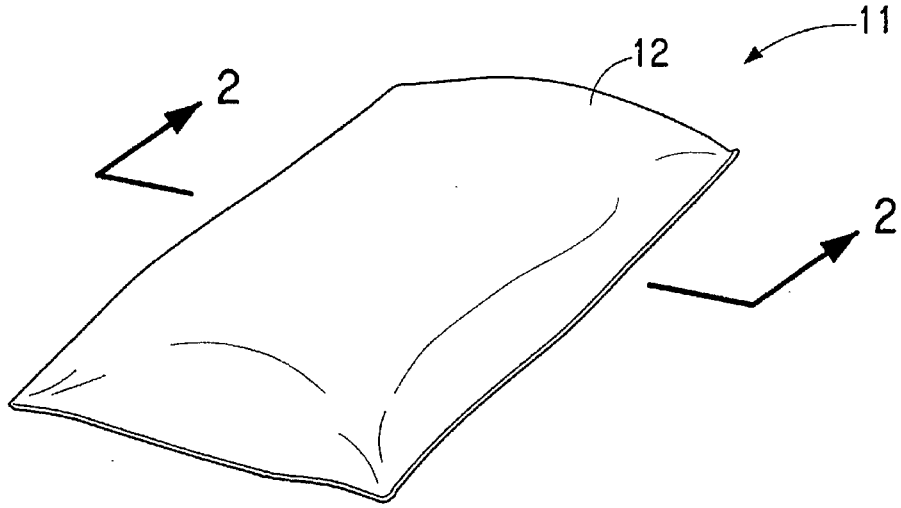
FIGS. 1 and 2, respectively, are views in perspective and in section (along 2—2 in FIG. 1) of representative pillows according to the prior art or according to the invention, as described in more detail hereinabove.
Figure 2:
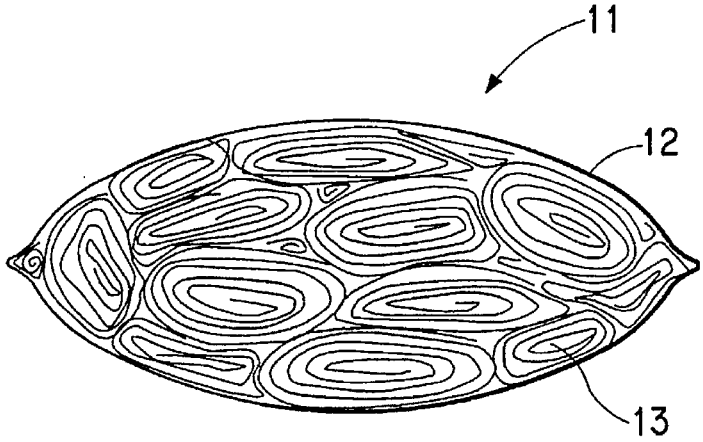

The constituent parts of a conventional pillow as made generally at this time have already been described above in the Background portion herein, and are well known to those skilled in the art, as described, for example, in the literature, e.g., referred to hereinabove, to which reference may be made for further details. Further details to describe the constituent parts and making of a pillow would be redundant in view of the knowledge of those skilled in the art, so there follows a discussion of comparative tests made on pillows with a ticking of fabric woven of yarns of synthetic polyester continuous filaments according to the invention and of pillows with similar filling, but enclosed within prior art fabrics (used as tickings). All DACRON® polyester fibers and yarns mentioned herein are available from DuPont DACRON®, Wilmington, Del. The FORTREL® feed yarns were provided by Wellman, Inc. of Johnsonville S.C.; and the ESP Type 606 feed yarn was provided by Hoechst Celanese Corp., Somerville N.J.

In Table 1, properties of pillows made according to this invention, using such continuous filamentary polyester yarn fabrics as ticking fabrics, are compared with properties of pillows made using representative currently-available commonly-used ticking fabrics. Each pillow contained 568 g of polyester fiberballs prepared in accordance with the procedure described in U.S. Pat. No. 5,344,707. In preparing the fiberballs, commercially-available DACRON® Type 136 subdenier (0.9 dpf) fibers were used, having been cut to 1.25 inch (32 mm) lengths from a drawn tow of polyethylene terephthalate filaments that had been conventionally mechanically crimped and slickened with a polysiloxane slickener; These filaments had been mechanically crimped to provide a primary crimp frequency of approximately 13 crimps per inch. Higher denier (6 dpf) slickened hollow bicomponent polyester fibers (commercially-available Unitika 6H-18X, tenacity 3.6 gpd, and elongation 65%) were cut to 38 mm lengths; in relaxed state, these fibers have spiral (sometimes referred to as helical, curvilinear, 3-dimensional or by other terms) crimp. 25% by weight of the subdenier fibers and 75% by weight of the higher denier fibers were blended on standard textile blending equipment. The resulting blend was opened on a Hollingsworth "Flock Feed" opener (available from John D. Hollingsworth-On-Wheels, Greenville, S.C.) and air-conveyed to an apparatus as described in Snyder U.S. Pat. No. 5,218,740 and processed into fiberballs which were used as filling material for the pillows in the following comparative tests. These fiberballs had low cohesion, which provided good refluffability, as discussed in the prior art referred to above.. Other methods for preparing fiberballs, such as that described in U.S. Pat. No. 4,618,531, could have been used.

Crimps per inch (CPI) were measured by the following procedure. A single relaxed fiber is placed between the damps of a device for measuring the length of a fiber. The clamps are first manually separated to extend the fiber to remove slack without removing crimp. The total number of crimps, defined as peaks and valleys, is counted (using a magnifying glass). Then the fiber is elongated to remove the crimp, and the uncrimped fiber length is measured.

$$\text{Crimps per inch} = \frac{\text{Total number of crimps}}{\text{Uncrimped fiber length (in inches)}}$$

This procedure is repeated for at least 10 filaments, using several feet of crimped tow, and selecting several representative sections, from which sections are cut and individual filaments are extracted. The average value of these measurements is calculated and used as crimps per inch (CPI).

Table 1 records the following measurements and calculations. Heights (commonly referred to as bulk measurements) were recorded in inches and were measured for IH (Initial Height) and 10 lb (Height under 10 pound load), and calculated for D (this first D, under the heading "Heights (inches)", being the difference between those measurements). The measurements were made conventionally and are summarized hereinbelow. Both the "Softness" and the "Firmess" are calculated values, as summarized below. All the foregoing data were recorded twice for each pillow, first in the lines labelled "I" (for the measurements made "Initially", i.e., before any treatment in a Fatigue Tester or washing and drying, as summarized hereinafter) and then in the lines labelled "F" (for the measurements made "Finally" i.e., after three compression, washing and drying cycles). On each line labelled "F", in addition to the F values (mentioned already), the differences between the Final Softness value (line F) and the Initial Softness value (line I) are recorded as the 2nd "Δ" (under the heading "Softness") and, similarly, the differences between the Final Firmess value (line F) and the Initial Firmess value (line I) are recorded as the 3rd "Δ" (under the heading "Firmess"), and the Δ values are recorded under the heading "Softness" being expressed as a percentage of the Initial Softness measured (and recorded on line I).

The bulk measurements reported in Table 1 were made conventionally on an "Instron" machine equipped with a foot 101.6 mm in diameter. Prior to measuring the "initial height" (IH), the pillow is compressed under a load of 0.2 lbs./sq.in. and the load released, to minimize height differences which could have resulted from differences in handling the pillow prior to measurement. The Instron is then used to measure the height of the pillow under no load (reported in Table 1 as "IH", for initial height) and the corresponding height under an applied load of ten pounds (reported in Table 1 as "10 lb"), and the load required to reduce the height to one half of the initial height. The difference between the initial height and the height under a load of ten pounds was calculated and is reported as the first "Δ", which appears under the heading "Heights (inches)" in Table 1.

"Softness" as this term is used herein is defined as the value obtained by dividing this first "Δ" (the difference between the initial height (IH) and the height under a load of ten pounds (10 lb.) by that initial height (IH), all heights being measured in inches). The "Softness" values are reported under the subheading "Value" under the overall heading "Softness" in Table 1. A higher "Softness" value indicates a softer pillow. The load required to compress the pillow to one-half of its height is considered to be a measure of firmness which is reported as "Value" in Table 1 under the heading "Firmess". As Firmness decreases, Softness increases, although the changes are not necessarily proportional.

Another important aspect of pillows is the retention of desirable properties with repeated use. To simulate prolonged normal use, a Fatigue Tester is conventionally used to alternately compress and release a pillow, using a series of overlapping shearing movements followed by fast compressions designed to produce the lumping, matting and fiber interlocking that normally occur with prolonged use of a pillow filled with fiberfill. To test these pillows, the compressions and releases were repeated 10,000 times, after which the pillows were washed and dried, using conventional washing and drying equipment. After each such compression, washing and drying series, the Instron height measurements were repeated. As already indicated, Table 1 records values for the initial measurements (identified as I) and for those made finally after three compression, washing and drying cycles (identified as F), and includes the differences between the "Softness values" reported intially (I) and finally (F) under the subheadings Δ and % Δ, and similarly for "Firmness" under the subheading Δ.

"% Δ Softness" as this term is used herein is defined as the difference between Softness values initially (I) and finally (F) after three compression, washing and drying cycles as defined herein, expressed as a percentage of their initial Softness values (I). Preferred pillows according to the invention have "% Δ Softness" of about 5 or less, and especially of about 3 or less.

As indicated, similar fillings of fiberballs of polyester fiberfill were used in each pillow, i.e., only the tickings were different. Pillows 1–4 were according to the invention, each of their tickings being fabrics of 100% continuous filament polyester yarns, as described hereinafter. Applicants chose and obtained these fabrics and used them as tickings for pillows according to the invention. Applicants were the first to use these fabrics as tickings for pillows. None of these continuous filamentary fabrics had previously been used for a pillow ticking.

1. The fabric that we chose as a ticking for our pillow No. 1 had been woven with a satin weave from 100% continuous filament false twist draw-textured polyester yarns, and a surface had been sanded; the fabric weighed 5.8 oz/yd$^2$, and was constructed with 120 ends/inch in the warp and 56 picks/inch in the weft. The continuous filament warp yarn was a false twist draw-textured yarn that had been made by false twist-draw texturing a 250(150)/50 DACRON® Type 242T draw-texturing feed yarn, i.e., the average filament denier of the false twist draw-textured warp yarn was 3 dpf; the continuous filament weft yarn was produced by plying together 2 textured ends of false twist draw-textured yarn, each of which had been made by false twist draw-texturing a 210(150)/132 FORTREL® Type 620 draw-texturing feed yarn, i.e., the average filament (drawn) denier of the plied weft yarn was 1.1 dpf;

2. This fabric (Burlington/Klopman S/3689 Supplesse) that we chose for our pillow No. 2 had been woven with a satin weave from 100% continuous filament false twist draw-textured polyester yarns; it weighed 5.2 oz/yd$^2$, and its fabric construction was 120 ends/inch in the warp and 64 picks/inch in the weft. The continuous filament warp yarn was a false twist draw-textured yarn, that had been made by false twist draw-texturing a 225(150)/200 DACRON® Type 56T draw-texturing feed yarn, i.e., the average filament denier of the false twist draw-textured warp yarn was 0.75 dpf the continuous filament weft yarn was a 70/33 false twist draw-textured yarn that had been made by false twist draw-texturing a 105(70)/33 ESP Type 606 draw-texturing feed yarn, i.e., the average filament denier of the false twist draw-textured weft yarn was 2.1 dpf;

3. This fabric (Burlington/Klopman S20506/1) that we chose for our pillow No. 3 had been woven with a plain weave from 100% continuous filament false twist draw-textured yarns; it was considerably lighter than the previous fabrics, weighing only 2.7 oz/yd$^2$, and was constructed with only 76 ends/inch in the warp and 56 picks/inch in the weft. The continuous filament warp yarn was a false twist draw-textured yarn that had been made by false twist draw-texturing a 250(150)/50 DACRON® Type 242T draw-texturing feed yarn, i.e., the average filament denier of the false twist draw-textured warp yarn was 3 dpf; the continuous filament weft yarn was a false twist draw-textured yarn that had been made by false twist draw-texturing a 225(150)/200 DACRON® Type 56T draw-texturing feed yarn, i.e., the average filament denier of the false twist draw-textured weft yarn was 0.75 dpf;

4. The fabric that we chose for our pillow No. 4 was a plain weave taffeta and a surface had been sanded; it weighed 3.4 oz/yd$^2$, with 120 false twist draw-textured continuous filament ends/inch in the warp and 76 continuous filament picks/inch in the weft. The continuous filament warp yarn was a false twist draw-textured yarn that had been made by false twist draw-texturing a 80(50)/47 DACRON® Type 690T draw-texturing feed yarn, i.e., the average filament denier of the false twist draw-textured warp yarn was just over 1 dpf; the continuous filament weft yarn was produced by plying together 2 textured ends of false twist draw-textured yarn, each of which had been made by false twist draw-texturing a 143(100)/129 FORTREL® Type 620 draw-texturing feed yarn, i.e., the average filament denier of the plied weft yarn was 0.8 dpf.

All the above four fabrics were woven from 100% continuous filament false twist draw-textured polyester yarns. We chose them and tested them for use as ticking fabrics. They had not previously been used for pillow ticking.

Pillows A–J were provided for comparison, similar fiberball fillings being enclosed within prior art commercial tickings, as described hereinafter. As will be seen, none of these prior art tickings were woven from 100% continuous filamentary yarns.

A. This prior art ticking fabric was a plain weave taffeta, probably calendered, weighing 3.18 oz/yd$^2$, and analyzed as containing about 20% cotton and 80% polyester. There were 112 warp ends/inch and 60 picks/inch. The warp contained only staple fibers without any continuous filaments but the weft did contain continuous filaments. The yarn sizes were measured as being 50 cotton count (cc) for the warp and 186.2 denier for the weft, and the average dpfs as 1.35 and 2.7, respectively;

B. This prior art ticking fabric appeared to be somewhat similar to A, a plain weave taffeta, weighing 3.05 oz/yd$^2$, about 20% cotton/80% polyester, 112 warp ends and 60 picks per inch. The yarn sizes were measured as 50 cc (warp) and 184.9 denier (weft), and the average dpfs as 1.4 and 2.7, respectively;

C. This prior art ticking fabric appeared to be somewhat lighter, but largely similar to A and B, plain weave taffeta, probably calendered, weighing 2.91 oz/yd$^2$, about 20% cotton/80% polyester, 108 warp ends and 56 picks/inch. The yarn sizes were measured as 48 cc (warp) and 186.6 denier (weft), and the average dpfs as 1.55 and 2.45, respectively;

D. This prior art ticking fabric was of 100% staple fiber without any continuous filaments, and analyzed as about 50% cotton/50% polyester (staple). It was a plain weave construction. It weighed 3.43 oz/yd$^2$, with 108 warp ends and 56 picks per inch. The yarn sizes were measured as 32 cc (warp) and 30 cc (weft), and the average dpfs as 1.3 and 1.4, respectively;

E. This prior art ticking fabric was of 100% polyester staple fibers without any continuous filaments. The weave was a plain weave taffeta, with 124 warp ends and 80 picks per inch, and the fabric weighed 3.81 oz/yd$^2$, and appeared to have been calendered. The yarn sizes were measured as 38 cc (warp) and 42 cc (weft), and both average dpfs as about 1.4;

G. This prior art ticking fabric was analyzed as 50/50 cotton/polyester (staple) like D without any continuous filament, and was a plain weave construction. It weighed 3.05 oz/yd$^2$, with 100 warp ends and 56 picks per inch. Both yarn sizes were measured as 34 cc and both average dpfs as about 1.1;

H. This prior art ticking fabric was analyzed as 30/70 cotton/polyester (staple) without any continuous filaments and was a plain weave construction. It weighed 3.55 oz/yd$^2$, with 148 warp ends and 72 picks per inch. The yarn sizes were measured as 36 cc (warp) and 40 cc (weft), and the average dpfs as 1.2 (warp) and 1.3 (weft);

J. This prior art ticking fabric was analyzed as 100% cotton without any continuous filaments, and was heavier than the other prior art fabrics, weighing 5.71 oz/yd$^2$. The weave appeared to be a 2×1 twill. Both warp and weft were of cotton, with 138 warp ends and 80 picks per inch. The yarn sizes were measured as 16 cc (warp) and 42 cc (weft), and the average dpfs as 1.46 (warp) and 1.74 (weft).

TABLE 1

| | | Heights (inches) | | | Softness | | | Firmness | |
|---|---|---|---|---|---|---|---|---|---|
| Item | I or F | 1 H | 10 lb | Δ | Value | Δ | %Δ | Value | Δ |
| | | | | Invention | | | | | |
| 1 | I | 8.79 | 2.85 | 5.94 | .676 | | | 5.13 | |
| | F | 7.97 | 2.45 | 5.52 | .693 | .017 | 2.5 | 4.74 | 0.39 |
| 2 | I | 8.91 | 2.28 | 6.63 | .744 | | | 4.12 | |
| | F | 8.23 | 2.15 | 6.08 | .739 | .005 | 0.7 | 3.91 | 0.21 |
| 3 | I | 9.30 | 2.78 | 6.52 | .701 | | | 4.78 | |
| | F | 7.92 | 1.95 | 5.97 | .754 | .053 | 7.5 | 3.59 | 1.19 |
| 4 | I | 9.12 | 2.95 | 6.17 | .677 | | | 5.07 | |
| | F | 8.34 | 2.55 | 5.79 | .694 | .018 | 2.6 | 4.46 | 0.61 |
| | | | | Comparisons | | | | | |
| A | I | 9.15 | 3.36 | 5.79 | .633 | | | 6.09 | |
| | F | 8.08 | 2.44 | 5.64 | .698 | .065 | 10.3 | 4.42 | 1.67 |
| B | I | 9.26 | 3.32 | 5.94 | .641 | | | 5.66 | |
| | F | 7.88 | 2.01 | 5.87 | .745 | .103 | 16.1 | 3.43 | 1.73 |
| C | I | 8.92 | 3.25 | 5.67 | .636 | | | 5.99 | |
| | F | 7.93 | 2.19 | 5.74 | .724 | .088 | 13.9 | 4.27 | 1.72 |
| D | I | 8.97 | 2.78 | 6.19 | .690 | | | 4.94 | |
| | F | 7.94 | 2.06 | 5.88 | .741 | .050 | 7.3 | 4.00 | 0.94 |
| E | I | 9.13 | 3.28 | 5.85 | .641 | | | 5.80 | |
| | F | 8.14 | 2.45 | 5.69 | .699 | .058 | 9.1 | 4.56 | 1.24 |
| G | I | 8.55 | 2.87 | 5.68 | .664 | | | 5.48 | |
| | F | 8.09 | 2.26 | 5.83 | .721 | .056 | 8.5 | 4.12 | 1.36 |
| H | I | 8.50 | 3.16 | 5.34 | .628 | | | 6.05 | |
| | F | 7.98 | 2.71 | 5.27 | .660 | .032 | 5.1 | 5.18 | 0.87 |
| J | I | 8.89 | 3.32 | 5.57 | .627 | | | 6.13 | |
| | F | 7.78 | 2.40 | 5.38 | .692 | .065 | 10.4 | 4.84 | 1.29 |

I = Before compression, washing and drying
F = After 3 compression, washing and drying cycles Preferences with respect to pillow characteristics vary considerably, but many people prefer a soft pillow with luxurious appearance and soft hand. As shown in Table 1, the initial height varied for both the pillows with tickings of the invention (1–4) and the pillows with comparison tickings (A–J) and there was a slight overlap. The average values for the two groups differed by only 1.5%, so initially all of the pillows had substantially the same height, described generally as "crown".

The Softness values for nearly all of the the pillows were somewhat increased by the compression, washing and drying cycles, but the differences (i.e., % Δ Softness) between the two groups after three cycles of compression, washing, and drying were surprising. Thus, the % Δ Softness for pillows #1–4 (according to the invention) were 0.7%, 2.5%, 2.6% and 7.5%, whereas the % Δ Softness for Comparisons #A–J were much higher, 5.1%, 7.3%, 8.5%, 9.1%, 10.3%, 10.4%, 13.9% and 16.1%. The extremely low % Δ Softness values of 2.5% and 2.6% (pillows #1 and 4) were only half the lowest value achievable using any of the commercial ticking fabrics tested of the prior art (5.1% for Comparison #H); these extremely low % Δ Softness (in contrast to the % Δ Softness ranging from about 5% to about 16% for the Comparisons) were themselves high in comparison to the 0.7% Δ Softness for item #2. So the provision of ticking fabrics woven wholly of yarns of synthetic polyester continuous filaments has made possible a completely new dimension of pillow Softness durability (significantly less variation of Softness when subjected to cycles of compression, washing and drying) as measured by % Δ Softness contrast with prior art tickings. Even pillow #3 (% Δ Softness 7.5) had a value that was comparatively low, in relation to the range of those measured for the Comparisons #A–J, which ranged from 5.1% up to 16.1%; the continuous filamentary yarn fabric used as ticking for pillow #3 was extremely lightweight, only 2.7 oz/yd$^2$ (not designed specifically for use as a ticking fabric), and so would not be expected to have Softness durability equivalent to those for the other pillows according to the invention.

Since very little increase in Softness values (% Δ Softness) resulted from the compression, washing and drying cycles for pillows made with tickings of this invention, the loads needed to compress the pillows to one-half height ("Firmess" values) were also compared and the decreases (Δs) in "Firmness" were similarly generally significant for the comparison pillows A–J, ranging from a Δ of 0.87 up to a Δ of 1.73, but not generally for the pillows 1 to 4 of this invention, being 0.39, 0.21, 1.19 and 0.61, respectively.

Thus, by using pillows of this invention we have shown that it is possible to obtain better durability, than for the comparative pillows (using commercially-available prior art tickings).

All the tests were made with pillows containing the same type and amount of filling material to ensure that the differences in physical properties of the pillows were affected only by the ticking fabric. We believe that the relative performance behavior of the rated ticking materials would be similar if different synthetic polyester filling materials were to be substituted in the same amount and kind of filling for each pillow. Fiberball/cluster fillings of different composition from those tested here, but falling within the scope described in U.S. Pat. Nos. 4,618,531, 4,794,038 and 5,218,740, for example, would be expected to produce equivalent performance when combined with tickings in pillows according to this invention. Likewise also fillings could be of rolled batts or deregistered continuous filamentary tows, for example.

By combining the new polyester continuous filamentary fabrics with polyester filling material, especially the fiberballs, surprising advantages in aesthetics and performance are provided according to the invention. The performance advantages of the ticking fabrics have been described already herein, and the performance advantages of fiberballs have been described in the art referred to. The combination in an all-polyester pillow provides washability and absence of problems, such as allergies, mildew and other defects of using natural fibrous materials, which is especially important for people with pulmonary susceptibilities. The silky aesthetics of fine dpfs fabrics has not been believed to have been suggested for ticking materials as opposed to pillow slips.

We claim:

1. A pillow comprising synthetic polyester fiberfill, as filling material, enclosed within a ticking of fabric woven wholly of yarns of synthetic polyester continuous filaments, wherein at least 10% by weight of said continuous filaments are of low denier about 0.4 to about 1.5.

2. A pillow according to claim 1, wherein 10 to 50% by weight of said continuous filaments are of low denier about 0.4 to about 1.5, and the remainder of said continuous filaments are of denier about 1.0 to about 6.0.

3. A pillow according to claim 2, wherein said remainder of said continuous filaments are of denier about 1.0 to about 3.0.

4. A pillow according to claim 2, wherein said continuous filaments of low denier are of denier about 0.4 to about 0.9.

5. A pillow according to any one of claims 1 to 4, wherein the ticking fabric is a sanded fabric.

* * * * *